US009446427B2

(12) United States Patent
Smith, Jr.

(10) Patent No.: US 9,446,427 B2
(45) Date of Patent: Sep. 20, 2016

(54) LIQUID SHEETING DEVICE

(71) Applicant: Donald Perry Smith, Jr., San Ramon, CA (US)

(72) Inventor: Donald Perry Smith, Jr., San Ramon, CA (US)

( * ) Notice: Subject to any disclaimer, the term of this patent is extended or adjusted under 35 U.S.C. 154(b) by 452 days.

(21) Appl. No.: 13/855,714

(22) Filed: Apr. 3, 2013

(65) Prior Publication Data

US 2013/0221125 A1 Aug. 29, 2013

Related U.S. Application Data

(63) Continuation-in-part of application No. 12/761,410, filed on Apr. 16, 2010, now abandoned.

(51) Int. Cl.
*B05B 17/08* (2006.01)
*E03C 1/04* (2006.01)

(52) U.S. Cl.
CPC ..... *B05B 17/085* (2013.01); *E03C 1/0404* (2013.01); *E03C 1/0407* (2013.01)

(58) Field of Classification Search
CPC ... B05B 17/08; B05B 17/085; E03C 1/0407; E03C 1/0404
USPC ..... 239/11, 345, 566, 16–32
See application file for complete search history.

(56) References Cited

U.S. PATENT DOCUMENTS 4,310,476 A * 1/1982 Nahra ..... A23C 3/037 137/88
4,881,280 A * 11/1989 Lesikar ..... B05B 1/044 239/193
5,115,974 A * 5/1992 Tobias ..... B05B 17/085 239/193
5,249,744 A * 10/1993 Ruthenberg ..... B05B 1/044 239/17
6,595,435 B1 * 7/2003 Cardenas ..... A61H 33/6063 239/17
7,194,774 B2 * 3/2007 Bergstrom ..... B05B 17/085 239/18
7,698,754 B2 * 4/2010 Kunkel ..... B05B 1/044 239/16

* cited by examiner

*Primary Examiner* — Arthur O Hall
*Assistant Examiner* — Chee-Chong Lee
(74) *Attorney, Agent, or Firm* — David E. Crites

(57) ABSTRACT

A method, system and an apparatus for liquid sheeting is disclosed. In one embodiment, an apparatus includes a channel to contain a flow of liquid and a coupling to a liquid source. The channel may include one or more channel ends that may be coupled to the liquid source. The apparatus may also comprise a liquid sheeting component having a length extending along a longitudinal axis of the channel, the liquid sheeting component comprising an outlet extending through a bottom of the channel and a first sheeting element extending from inside the channel through the bottom of the channel, wherein the first sheeting element and the outlet are adjacent and extend the length of the liquid sheeting component and the liquid sheeting component divides the channel longitudinally into at least two side-by-side sub-channels such that a bottom portion of the channel is divided and a top portion of the channel is undivided. The apparatus may also comprise a second sheeting element extending from inside the channel through the bottom of the channel for the length of the liquid sheeting component.

10 Claims, 13 Drawing Sheets

CROSS SECTIONAL VIEW

CROSS SECTIONAL VIEW

TOP VIEW

LIQUID SHEETING DEVICE

CLAIM OF PRIORITY

This application is a continuation-in-part of U.S. patent application Ser. No. 12/761,410 filed on Apr. 16, 2010 titled "A LIQUID SHEETING DEVICE".

FIELD OF TECHNOLOGY

This disclosure relates generally to a technical field of mechanical devices and, in one embodiment, to a method, system and apparatus of a liquid sheeting device.

BACKGROUND

A liquid dispensing apparatus for decorative or industrial purposes may be designed for dispensing liquid in a uniform sheet. Such a liquid dispensing apparatus may be used for a variety of applications because the apparatus can be sized to produce many sizes of liquid sheeting. In addition, the liquid dispensing apparatus may be inexpensive as it may be constructed from common elements and in few manufacturing steps.

SUMMARY

A method, system and apparatus of a liquid sheeting device is disclosed. In one embodiment, an apparatus includes a channel to allow a flow of liquid (e.g., water), wherein the channel is coupled to a liquid source. The channel may have one or more ends, and one or more of the ends of the channel may be coupled to a liquid source. The apparatus may include a liquid sheeting component extending along the longitudinal axis of the channel, from inside the channel down through the bottom of the channel. The liquid sheeting component may comprise one or more sheeting elements structurally coupled to the channel. The liquid sheeting component may divide the channel into two or more side-by-side sub-channels along a longitudinal axis of the channel. The liquid sheeting component may divide the channel into a right and left channels. The liquid sheeting component may divide a bottom portion of the channel but may leave a top portion of the channel undivided. The liquid sheeting component may further comprise an outlet extending along the longitudinal axis of the channel to allow the liquid in the channel to fall through the outlet in a sheet. The apparatus may further include one or more caps coupled to one or more ends of the channel. One or more caps may include a liquid inlet. The channel may be, but is not limited to, any of a pipe, a conduit, and a duct.

In another embodiment, a system may include a liquid sheeting apparatus that may include a channel and a liquid sheeting component coupled to the channel to generate a sheet of liquid. In addition, the system may also include a liquid source. The system may also include a pumping device to supply a continuous flow of liquid to the liquid sheeting apparatus through a connection. The connection may be a pipe or tube.

In yet another embodiment, a method of manufacturing an apparatus may include forming a longitudinal opening along the bottom of a channel. The method may include forming a liquid sheeting component of length and width substantially equal to the opening of the channel, with an outlet gap running through the center of the liquid sheeting component. The liquid sheeting component may be made of one or more sheeting elements or may be one formed piece. In some embodiments the sheeting elements are sheets of plastic. The sheeting elements may be a plastic, metal or any suitable material. The method may also include coupling and securing the liquid sheeting component to the channel such that a part of the liquid sheeting component is inserted through the opening of the channel such that a part of the liquid sheeting component is above the inside surface of the channel and a remaining part of the liquid sheeting component is below the channel.

The method and apparatus may further include coupling an inlet cap to a first end of the channel and coupling a covering cap to the second end of the channel. In some embodiments, the inlet cap may comprise an inlet offset to one side of the center of the inlet cap to enable a flow of liquid into the channel.

The method may include selecting one or more pieces of sheeting material to form the sheeting element(s) of the liquid sheeting component. In some embodiments, the liquid sheeting component may have one sheeting element situated adjacent to the outlet wherein the length of the sheeting element and the length of the outlet are along the longitudinal axis of the channel. In some embodiments, the liquid sheeting component may have two sheeting elements situated on either side of the outlet with two thin side-members keeping the two pieces of sheeting material from touching. In some embodiments, a distance between the two pieces is the outlet gap. In this and other embodiments, the inside of the liquid sheeting component may be a narrow rectangular tube with the two sheeting elements forming the longitudinal sides of the rectangular tube and the two thin side-members forming the short sides of the rectangular tube. In some embodiments, one sheeting element may have a greater width than the other sheeting element. In some embodiments, the wider sheeting element may extend vertically above the narrower sheeting element a distance greater than or equal to the width of the outlet gap. In some embodiments, the liquid sheeting component may be secured to a horizontal channel such that the tubular portion of the liquid sheeting component runs generally vertically allowing liquid in the channel to flow into the top of the liquid sheeting component and out the bottom of the liquid sheeting component.

The method may include manufacturing the inlet cap such the inlet is horizontally offset from a virtual centerline of the channel. In some embodiments, the offset may be such that the entire inlet is confined to one side of a virtual centerline of the channel. In some embodiments, the inlet may be offset towards the side of the liquid sheeting component having the longer sheeting element. The method and system may also include providing a route for liquid flow from a liquid source to the channel using a tube inserted through the inlet cap. The channel described herein may be any of, but not limited to a pipe, a conduit, and a duct.

Other embodiments will be apparent from the following description and the appended claims.

BRIEF DESCRIPTION OF THE VIEWS OF DRAWINGS

Example embodiments are illustrated by way of example and not limitation in the figures of accompanying drawings, in which like references indicate similar elements and in which.

Other features of the present embodiments will be apparent from accompanying Drawings and from the Detailed Description that follows.

DETAILED DESCRIPTION

An apparatus, method, and system for liquid sheeting is disclosed. In the following description, for the purpose of explanation, numerous specific details of some embodiments are set forth in order to provide a thorough understanding of the various embodiments. Liquid sheeting is used for industrial, commercial, and decorative purposes in industrial, commercial, and residential areas. Liquid sheeting is provided by regulating a flow of liquid to obtain an effectively uniform sheet of liquid.

Figure 1:
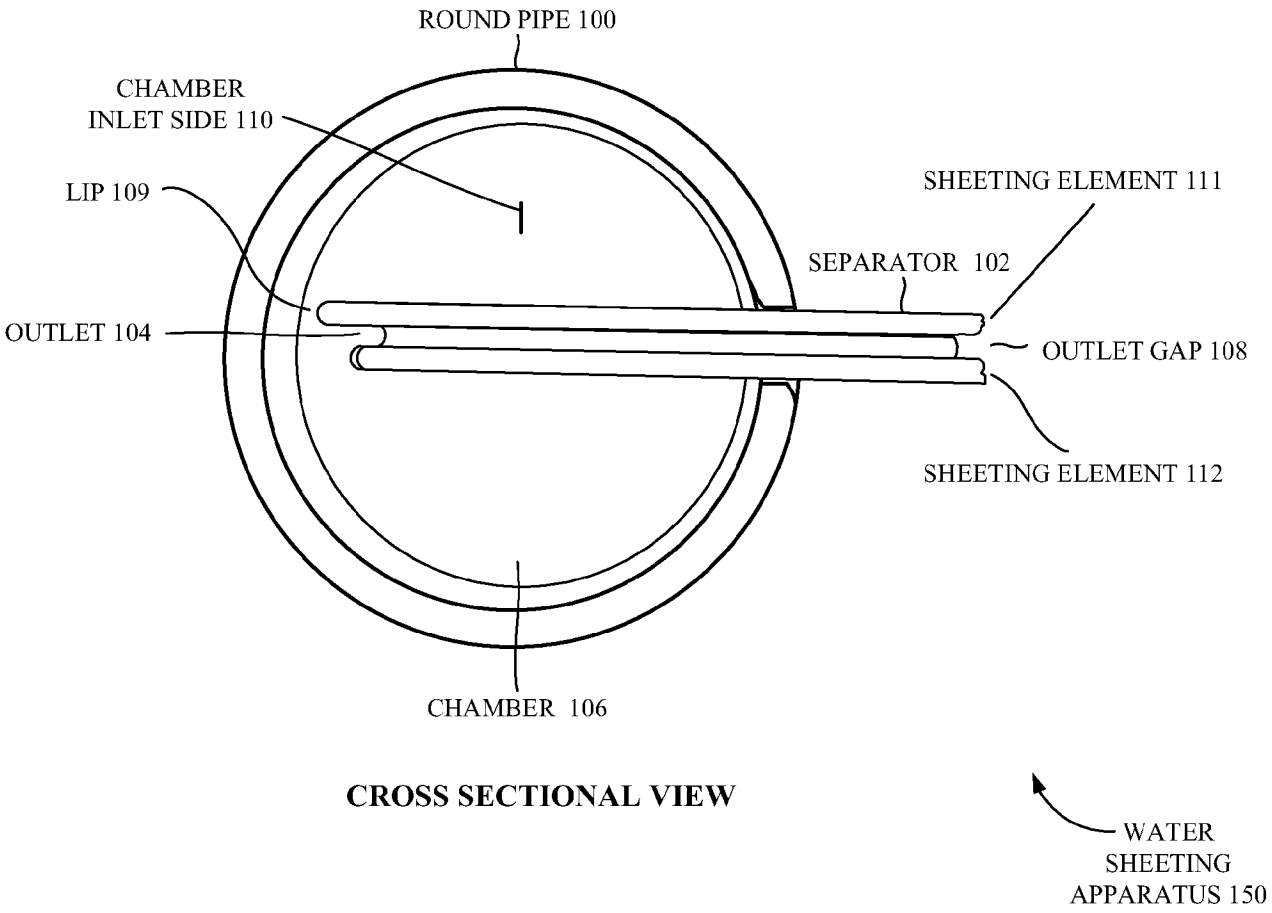
FIG. 1 is a cross section view of a liquid sheeting apparatus, according to one or more embodiments.
Figure 3:
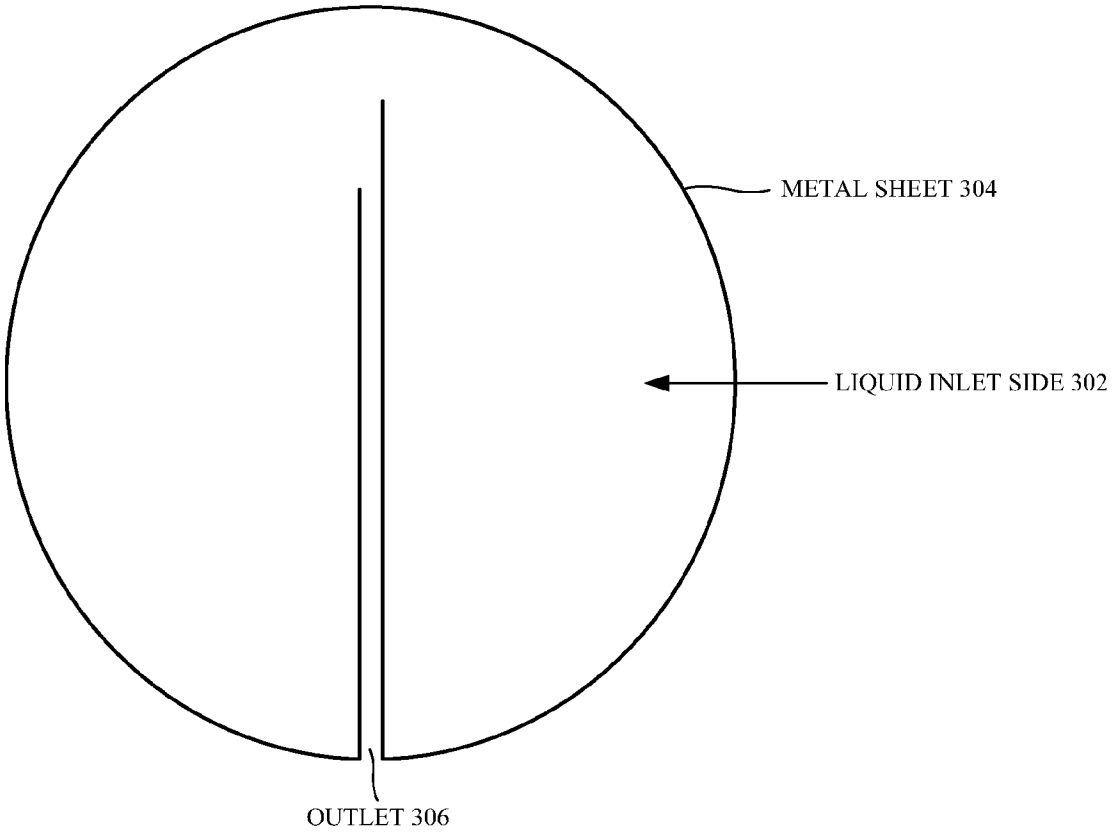
FIG. 3 is a cross sectional view of a liquid sheeting apparatus, according to an alternate embodiment.

FIG. 1 is a cross section view of a liquid sheeting apparatus 150, according to one or more embodiments. The liquid sheeting apparatus 150 is used to obtain a uniform sheet of liquid. The liquid sheeting apparatus 150 includes a channel, a liquid sheeting component (e.g., a separator 102 as described herein) and caps covering the ends of the channel. In one or more embodiments, the channel may be used for directing a flow of liquid. The channel may be a concrete cylindrical shaped pipe, a square shaped metal pipe, or another channel capable of containing liquid according to the requirements of applications. In an example embodiment, a Poly Vinyl Chloride (P.V.C) pipe 100 may be used as a channel to direct the flow of liquid. The separator 102 may be a component used to direct a flow of liquid from the channel to an outlet. The separator 102 may separate or divide the channel into right-and-left sub-channels or one or more side-by-side sub-channels along the longitudinal axis of the channel. The side-by-side sub-channels may have a vertical side or may have a non-vertical side. The separator 102 may separate or divide a bottom portion of the channel but may leave a top portion of the channel undivided. The separator 102 may comprise the outlet 104 of the liquid sheeting apparatus 150. In one or more embodiments, the dimensions of the separator 102 and the size of the lip 109 of the separator 102 can modified to meet the requirements of the application. The pipe 100 may be cut along its length to create a slot or opening for the separator 102. In one or more embodiments, the separator 102 may be comprised of one or more liquid sheeting elements 111, 112 made up of any material including, but not limited to, metal and plastic. The pipe 100 length may be cut according to the dimensions of the separator 102 such that the separator 102 may fit in the pipe 100. In alternate embodiments, a metal sheet 304 may be used to design the liquid sheeting apparatus. The metal sheet may be bent and designed as the liquid sheeting apparatus to generate a thin sheet of liquid. Caps for the liquid sheeting apparatus may be designed as required by the application. FIG. 3 illustrates a cross section view of the liquid sheeting apparatus constructed using a metal sheet, according to an alternate embodiment. In other embodiments, plastic may be used for designing the liquid sheeting apparatus as illustrated in FIG. 3. In some embodiments the channel and separator may be manufactured as one piece rather than assembled from separate components. In some embodiments one or more caps may be manufactured as part of the channel rather than assembled from separate components.

Figure 11:
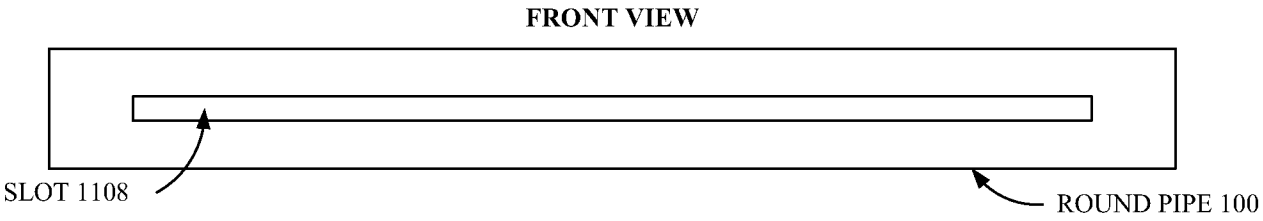
FIG. 11 is a front view of the channel, according to an example embodiment.

In an example embodiment, a round P.V.C. pipe 100 with dimensions of 21 inches in length, an outer diameter of 2.375 inches, and an inner diameter of 2 inches is used as the channel. The P.V.C. pipe is used as a channel in the example embodiment because of light weight, low cost, portability, and ease of use. An 18 inch line may be drawn along the length of the pipe leaving 1.5 inches on both the ends of the pipe. A slot 1108 measuring 18 inch in length and 0.25 inch to 0.281 inch wide may be cut over the drawn line along the length of the pipe using a router and a 0.25 inch straight bit tool (as illustrated in FIG. 11).

Figure 12:
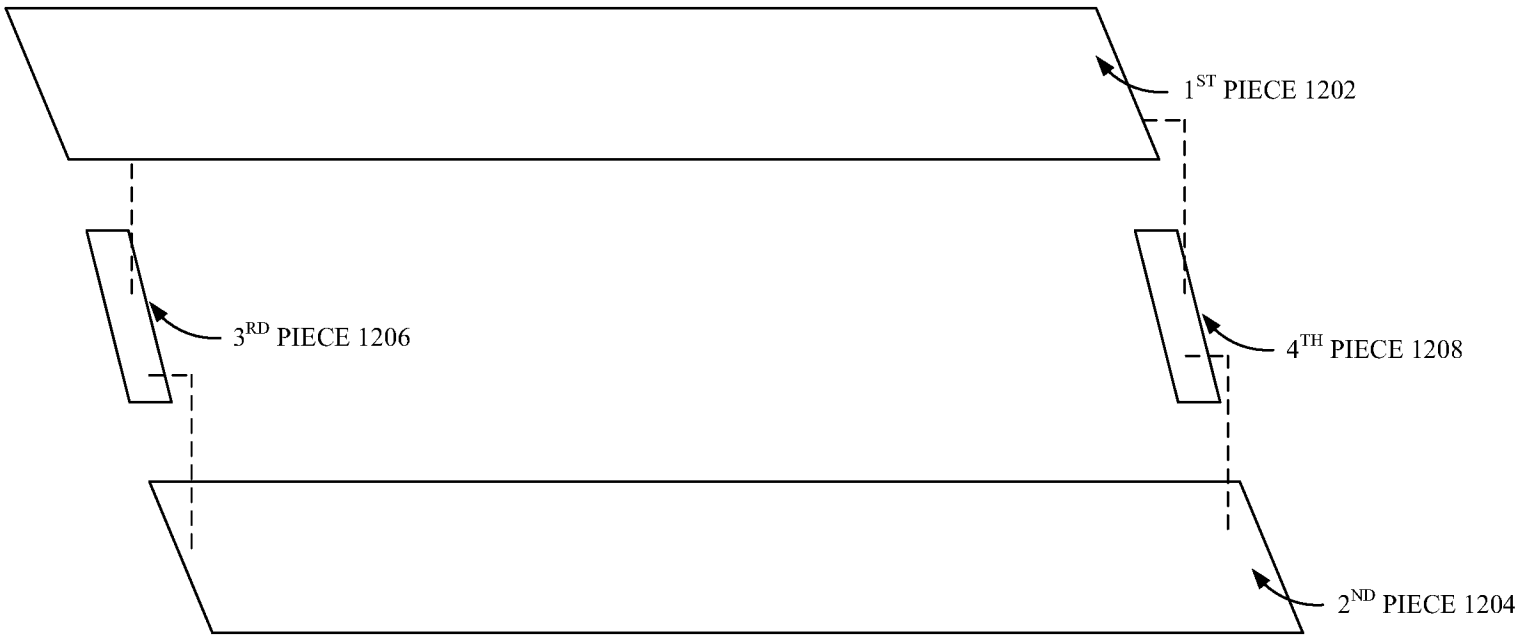
FIG. 12 is an angled view of the individual separator pieces, according to an example embodiment.
Figure 13:
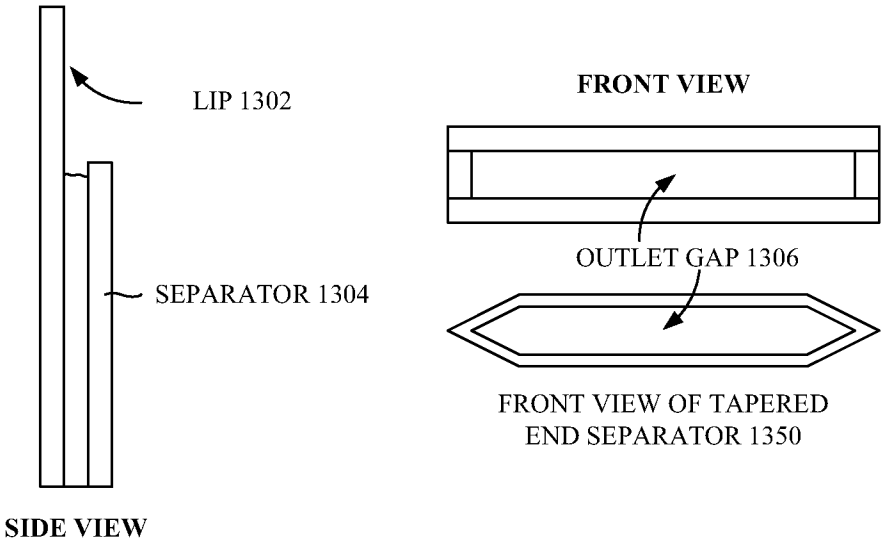
FIG. 13 is a side view and front view of the assembled separator and a front view of the tapered end separator according to an example embodiment.

The separator 102 (e.g., a liquid sheeting component), as illustrated in the example embodiment, may be of plastic material. A plastic sheet of thickness 0.083 to 0.09375 may be used and four pieces of the example dimensions may be cut namely, the first piece 1202 measuring 2.75 inch×18 inch, the second piece 1204 measuring 3 inch×18 inch, and the third piece 1206 and the fourth piece 1208 measuring 2.75 inch×0.125 inch may be cut (as illustrated in FIG. 12). These four cut pieces may be coupled together by adhesion or other means. The third piece 1206 measuring 2.75 inch× 0.125 inch may be secured flush with three edges of the first piece along a 2.75 inch sides of the first piece 1202 using a quick bond glue or other suitable means. The forth pieces 1208 may be similarly secured flush with three edges of the first piece along the other 2.75 inch side of the first piece 1202, and on the same surface of the first piece. The second piece 1204 measuring 3 inch×18 inch may then be coupled to the third piece 1206 and forth piece 1208 leaving a 0.25 inch×18 inch lip 1302 extending on one side and flush with the other pieces elsewhere. In some embodiments the size of the lip may be related to the time it may take for the apparatus to purge itself of air before producing a smooth sheet. In this example, the coupled separator component 1304 may have an outlet gap 1306 of 0.083 to 0.09375 inch between the first and second pieces, and a total thickness of 0.25 to 0.281 inch. (As illustrated in FIG. 13). The separator 1304 may be designed with other dimensions, in any preferred way based on a design required. FIG. 13 illustrates an example of a flat end separator and a tapered end separator 1350.

Figure 2:
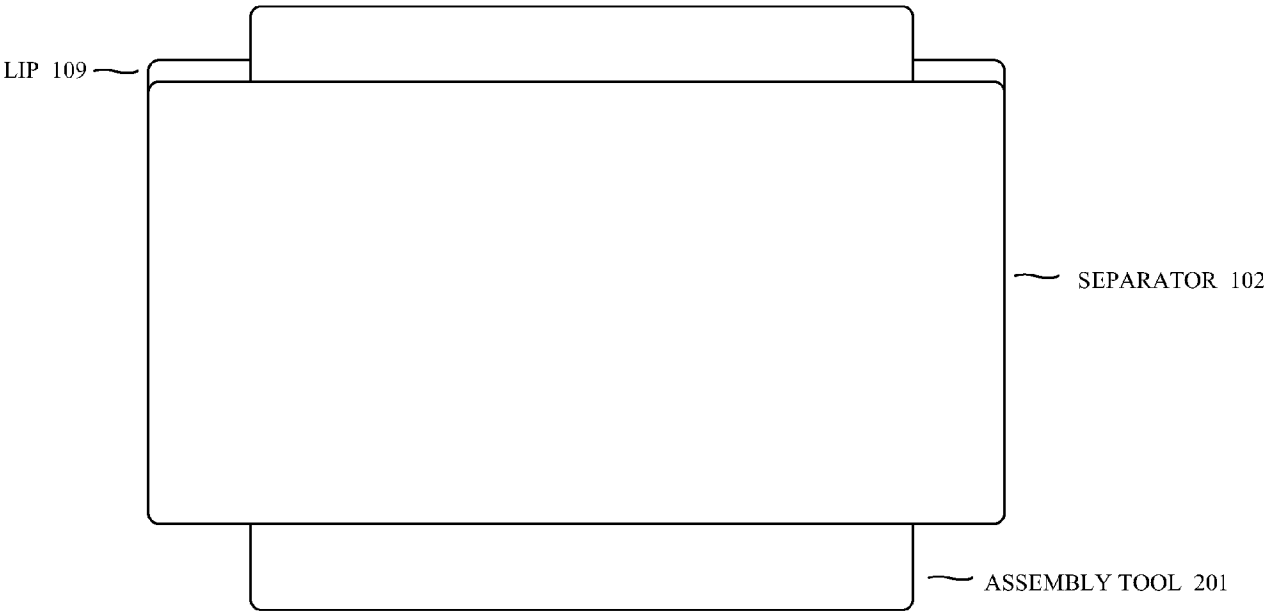
FIG. 2 is a top view of an assembly tool that may be used to mount the liquid sheeting apparatus, according to one or more embodiments.

FIG. 2 is a top view of an assembly tool of the liquid sheeting apparatus, according to some embodiments. In some embodiments, the assembly tool may be used to align the separator 102 component into the slot created in the pipe 100. The assembly tool 201 may be of any material and dimensions, according to the requirements of the applications. In the example embodiment, an assembly tool measuring 17.5 inch×4 inch may be cut from 0.083 to 0.09375 plastic sheet. The assembly tool 201 may be inserted in the separator 102 assembly as shown in FIG. 2. The assembly tool may be positioned and temporarily secured inside the separator such that 0.125 inch to 0.25 inch of the assembly tool extends beyond the lip of the separator 102.

Figure 4:
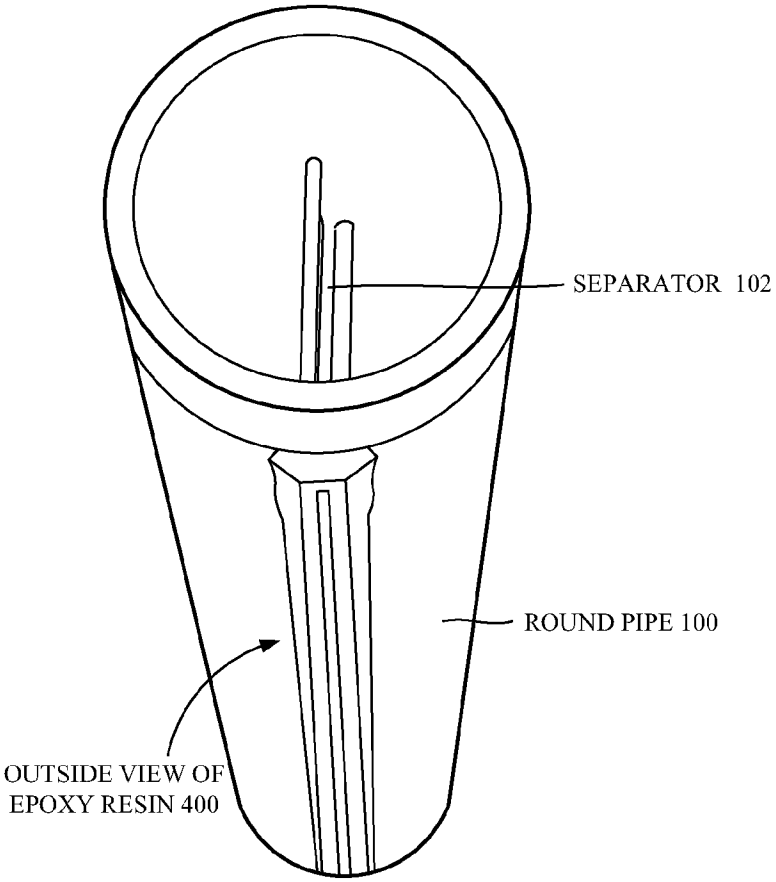
FIG. 4 is an angled view of the liquid sheeting apparatus, according to one or more embodiments.

In the example, the separator 102 component along with the assembly tool may be placed in the slot that was created in the P.V.C. pipe 100. In the example embodiment, the separator and assembly tool may be placed in the 0.25 to 0.281 inch gap of the 2 inch P.V.C. pipe 100 such that the assembly tool bottoms out on the inside of the P.V.C. pipe 100 ensuring the lip gap 502 between the inside of the P.V.C. pipe 100 and the separator 102 lip may be 0.125 inch to 0.25 inch. The lip gap may be the shortest distance between the top of the separator and the inside of the pipe. In the example embodiment, epoxy resin 400 may be applied on the coupling areas of the P.V.C. pipe 100 where the separator 102 and the P.V.C. pipe 100 are aligned. In some embodiments, the epoxy resin may be applied at coupling areas internal to the pipe 100 and external to the pipe (e.g., as illustrated in FIG. 4).

Figure 5:
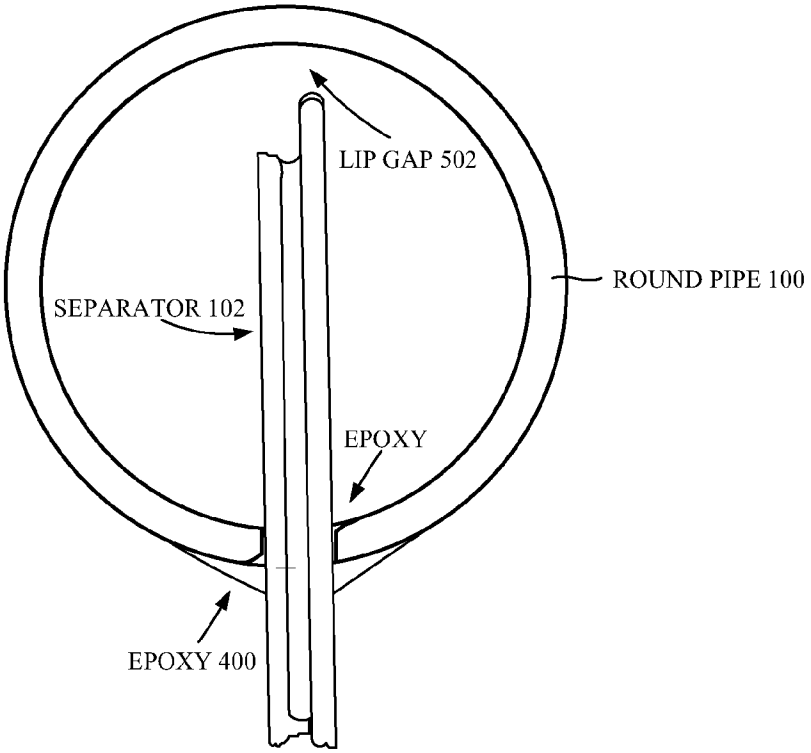
FIG. 5 is a cross sectional view of the liquid sheeting apparatus illustrating a constructed structure, according to an example embodiment.

In the example, epoxy resin 400 may be used because of its high strength, dimensional stability corrosion resistance, and liquid proofing. In the example, the separator 102 may be coupled to the inside of the P.V.C. pipe 100 by applying the epoxy resin 400 into the P.V.C. pipe 100. The epoxy resin 400 may be left to dry. When the epoxy resin 400 dries the example separator 102 may have a liquid-tight bond with the P.V.C. pipe 100. The example assembly tool may be removed once the liquid-tight bond is achieved between the separator 102 and the P.V.C. pipe 100 (As illustrated in FIG. 4 and FIG. 5).

Figure 6:
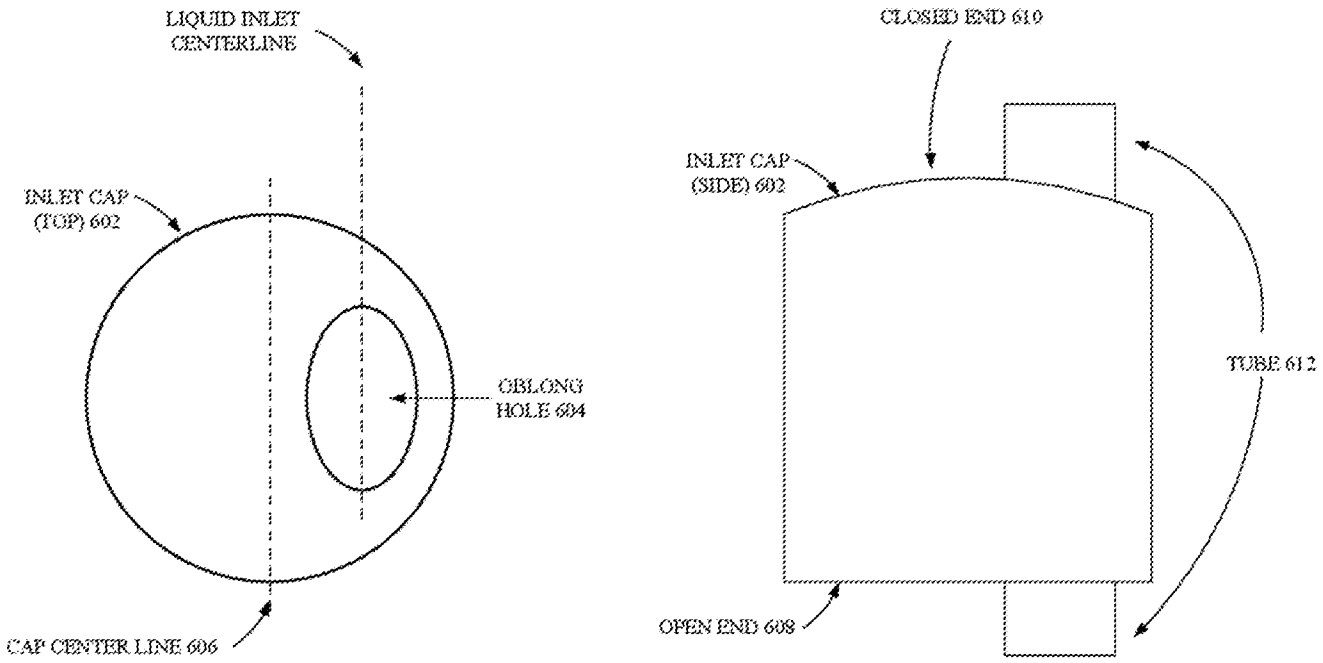
FIG. 6 is a schematic view of an inlet cap illustrating a positional alignment of an oblong hole inlet with respect to a centre line of the inlet cap, and an insertion of a pipe into the positioned oblong hole, according to an example embodiment.

In some embodiments liquid may be provided through an inlet cap 602 (e.g., illustrated in FIG. 6). According to the example embodiment, the inlet cap 602 may be coupled to either end of the pipe 100. In other embodiments the liquid may be provided through an inlet in the side of the pipe rather than, or in addition to, an end of the pipe.

FIG. 6 is a schematic view of an inlet cap of some embodiments, illustrating a positional alignment of an oblong hole 604 with respect to a centre line of the cap, and an insertion of a tube 612 into the positioned oblong hole, according to an example embodiment. In the example embodiment, the inlet cap 602 is a P.V.C. pipe cap designed for use with P.V.C. pipe with an outside diameter of 2.375 inches. In some embodiments, an oblong hole 604 may be created in one half of the cap, offset from a vertical center line 606 of the cap. The dimensions of the oblong hole 604, according to the example embodiment, may be 1.5 inch long×1 inch wide. In alternate embodiments, any kind of opening may be formed, not limited to an oblong hole.

Figure 7:
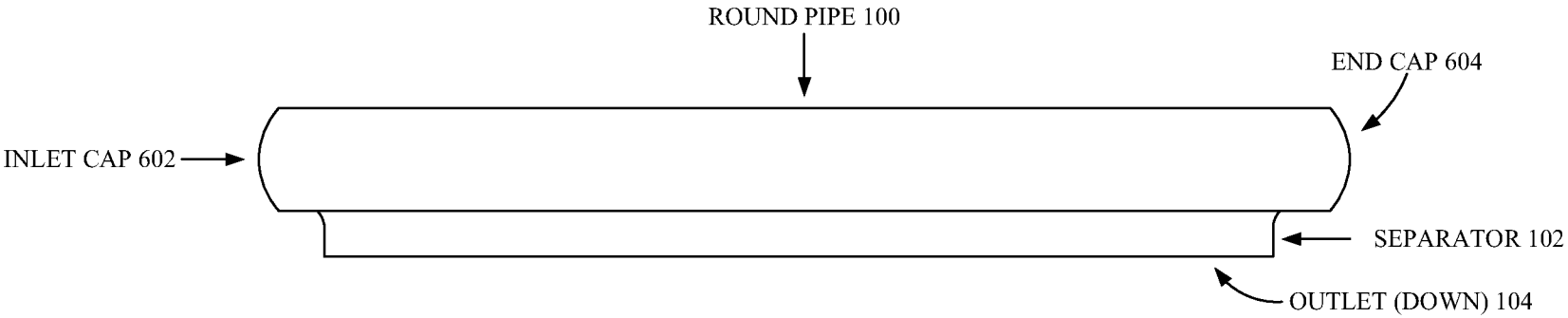
FIG. 7 is a back view of the liquid sheeting apparatus, according to one or more embodiments.
Figure 8:
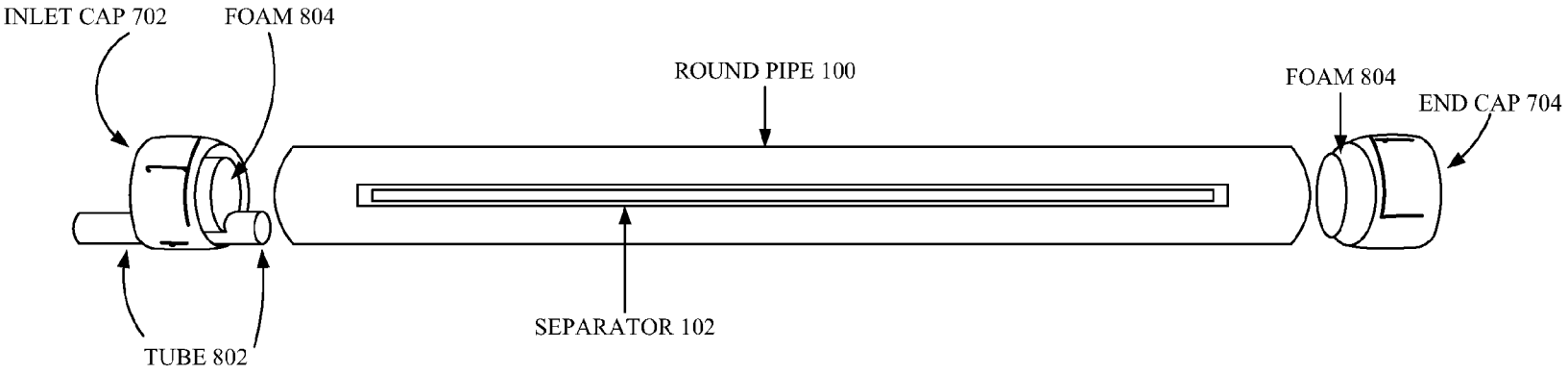
FIG. 8 is a front view of liquid sheeting apparatus, illustrating the assembly of the channel with end caps, according to an example embodiment.
Figure 10:
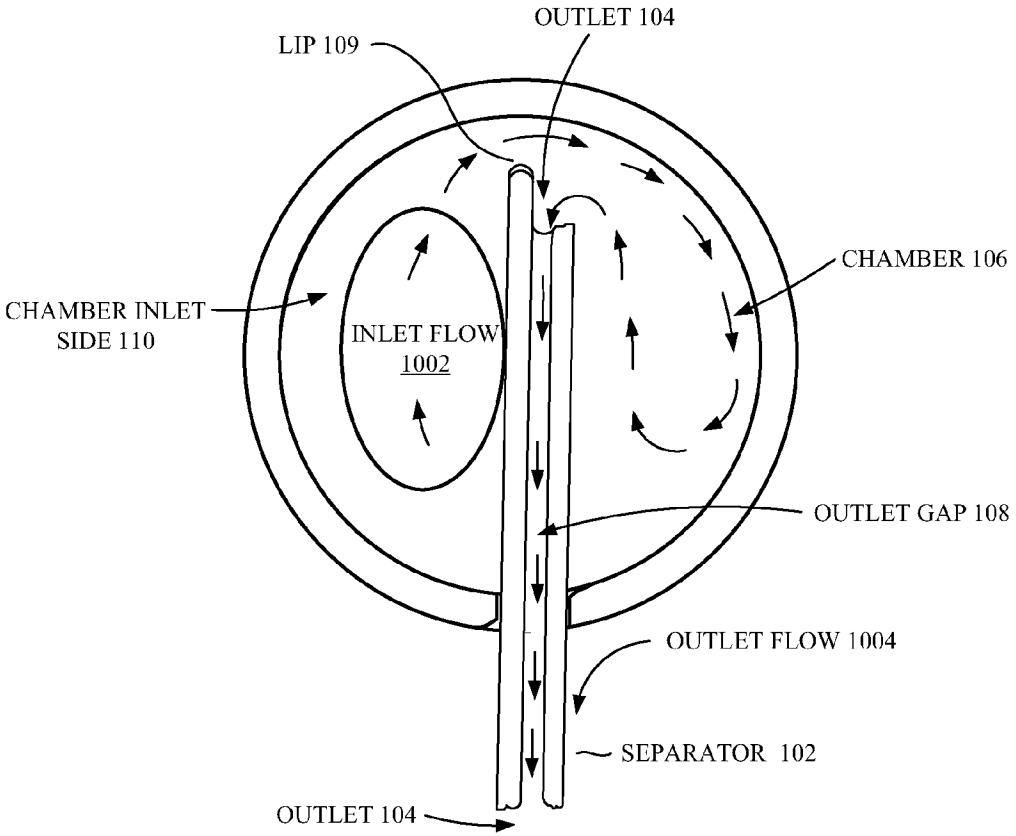
FIG. 10 is a cross section view of the liquid sheeting apparatus illustrating a flow of liquid in the liquid sheeting apparatus, according to an example embodiment.

According to the example embodiment, a P.V.C. tube 612 measuring 4 inch in length having an outer diameter 1.25 inch and with an inner diameter of 1 inch is cut. In the example, the tube 612 may be deformed and inserted into the oblong hole 604 cut in the inlet cap 602 and positioned such that 1.5 inch of the tube may extend out from the closed end 610 of the inlet cap 602. The cap and the P.V.C. tube may be coupled using epoxy resin to obtain a liquid tight seal. In some embodiments a piece of liquid proof foam 804 may be inserted into the inlet cap 602 and the end cap 704 such that the foam may compress against the separator inside the P.V.C. pipe when the end cap 704 and the inlet cap 602 (as illustrated in FIG. 8) are coupled to the P.V.C. pipe 100. In some embodiments, the foam 804 provides a snug fit between the inside of the P.V.C. pipe 100, the inlet tube 802, the separator 102, and the inlet cap 702. In some embodiments the foam provides a liquid-tight fit between the pipe, tube, inlet cap, and separator when sealed. FIG. 7 is a back view of the liquid sheeting apparatus, according to one or more embodiments. In the example, the inlet cap may be installed such that the inlet tube is on the side of the separator 102 having the lip (as illustrated in FIG. 10). Introducing liquid into both ends of the liquid sheeting apparatus, and through the sides of the channel, may enable the apparatus to have extended lengths or mixing capabilities. In some embodiments, a blank 2 inch end cap may be installed on the end of the pipe not having an inlet. A rubber mallet may be used to tap the caps to obtain a snug liquid-tight fit.

FIG. 10 is a cross section view of an example liquid sheeting apparatus illustrating an example flow of liquid. In the example embodiment, liquid enters through the inlet cap of the apparatus (perpendicular to the FIG. 10 cross-section plane) into the inlet chamber 110 side of the separator 102. In the example, the inlet flow 1002 circulates into chamber 106 and from there into the outlet gap 108 of the separator 102 which produces the outlet flow 1004 of the liquid in the form of a uniform sheet at the outlet 104. In this example embodiment, the inlet chamber 110 and chamber 106 are sub-channels of the pipe 100.

In alternate embodiments, the liquid sheeting apparatus can be constructed using metals or plastic and the material may be bent to obtain the apparatus elements. Parts may be welded or soldered according to the requirements of the applications. The liquid sheeting apparatus may be configured to be large or small. In some embodiments, the outlet gap 108 and the lip gap 502 of the separator 102 may be configured as per the application requirements. In some embodiments, a filter may be used to trap debris at the inlet cap or near a pump. In some embodiments, the plumbing and the inlet inner diameter may be half the inner diameter of the pipe 100. Decorative elements or additional functional elements (e.g. mounting elements) may be added to the apparatus.

Figure 9:
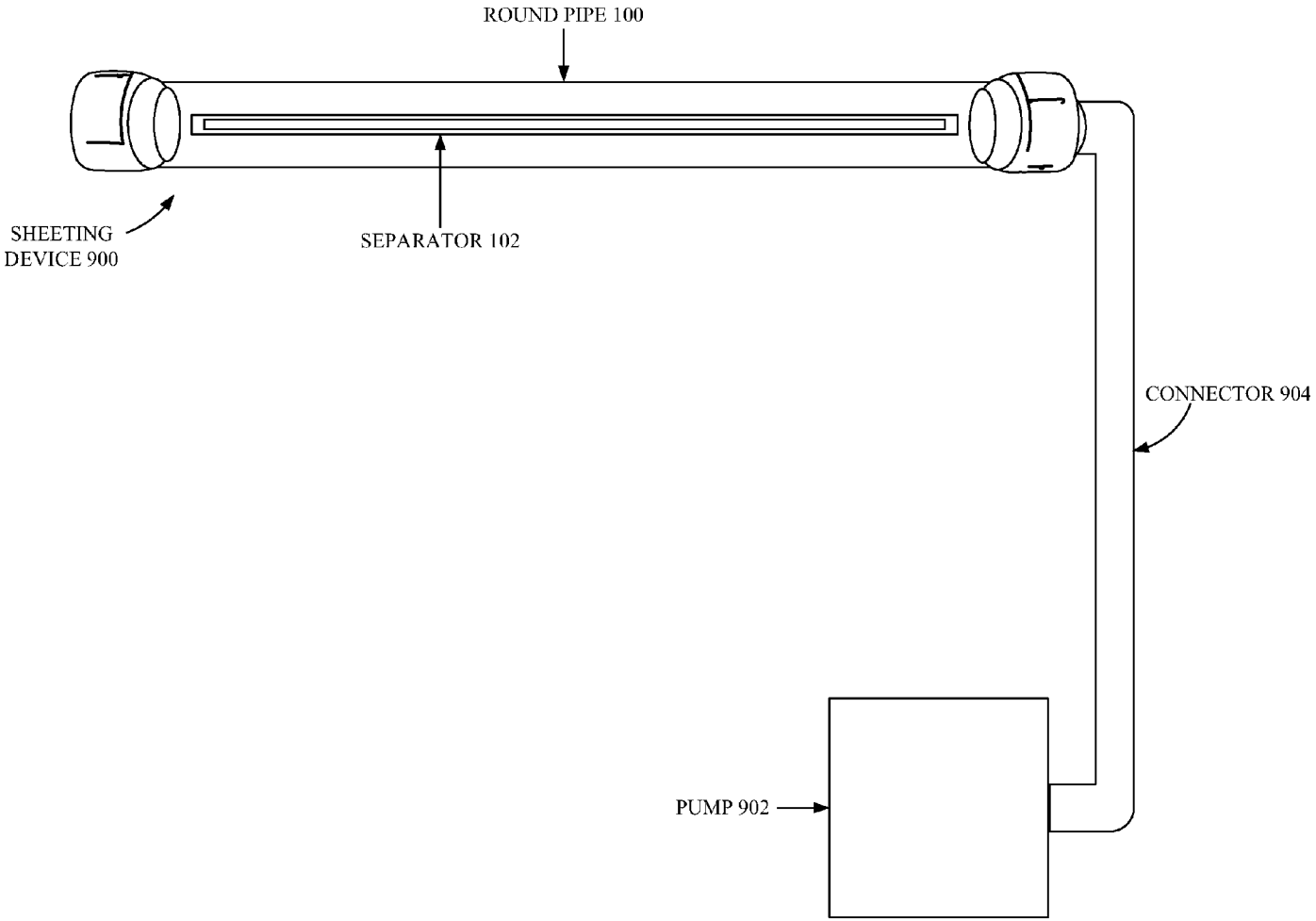
FIG. 9 is a system view illustrating the liquid sheeting apparatus coupling with a liquid source, according to an example embodiment.

In the example embodiment, for a 2 inch inner diameter and 18 inch width liquid sheeting apparatus configuration, a 600 GPH submersible small pond pump with a 0.75 inch to 1 inch inner diameter may be used to produce the required pressure and volume to produce a 24 inch long liquid sheet that may be 17.75 inch wide at the top of the sheet tapering to about 16 inch wide at the bottom of the sheet. In some embodiments, the length of the liquid sheet may be adjusted by varying the pressure and volume of the liquid applied to the liquid sheeting apparatus 150. In the example, plumbing may be used to connect the liquid sheeting apparatus 150 to the pump 902. In the example, a connector 904 measuring 40 inch in length with 1 inch inner diameter may be used to connect the sheeting apparatus 900 with the pump 902. (As illustrated in FIG. 9).

Although the present embodiments have been described with reference to specific example embodiments, it will be evident that various modifications and changes may be made to these embodiments without departing from the broader spirit and scope of the various embodiments. Accordingly, the specification and drawings are to be regarded in an illustrative rather than a restrictive sense.

What is claimed is:

1. An apparatus for sheeting a liquid, the apparatus comprising:

a coupling to accept the liquid;

a substantially horizontal channel to accept the liquid;

a liquid sheeting component having a length extending along a longitudinal axis of the channel, the liquid sheeting component comprising a first and second sheeting elements extending from inside of the channel through the bottom of the channel for the length of the liquid sheeting component, such that an outlet is defined between the first and second sheeting elements, wherein the liquid sheeting component divides the channel longitudinally into at least two side-by-side sub-channels that accept the liquid such that a lower portion of the channel is divided and an upper portion of the channel is undivided;

wherein the first and second sheeting elements are oriented substantially parallel to one another and longitudinally aligned with the channel; the first and second sheeting elements are offset in height within the channel to form a vertical offset gap;

wherein the vertical offset gap is greater than or equal to a distance between the highest top of one of the first and second sheeting elements and a closest inner surface of the channel.

2. The apparatus of claim 1: wherein the channel is a pipe.

3. The apparatus of claim 2: wherein the coupling comprises a first cap on a first end of the pipe, wherein the first cap comprises a liquid inlet.

4. The apparatus of claim 3 wherein a first virtual centerline that vertically bisects the liquid inlet is horizontally offset to one side of a second virtual centerline that vertically bisects an end of the first cap.

5. The apparatus of claim 4 wherein the liquid inlet is confined to one side of the second virtual centerline.

6. The apparatus of claim 3 wherein the liquid inlet is elongated in a vertical direction.

7. The apparatus of claim 1 wherein the outlet has a narrowest measurement and the distance is greater than or equal to the narrowest measurement of the outlet.

8. The apparatus of claim 3 further comprising a second cap on a second end of the pipe.

9. The apparatus of claim 1 wherein the liquid sheeting component extends below the channel.

10. The apparatus of claim 1 wherein the outlet has a narrowest measurement and the vertical offset gap is greater than or equal to the narrowest measurement of the outlet.

* * * * *